US008597033B2

(12) United States Patent
Xie et al.

(10) Patent No.: US 8,597,033 B2
(45) Date of Patent: Dec. 3, 2013

(54) RECEPTACLE CONNECTOR

(75) Inventors: Bao-Geng Xie, Guang-Dong (CN); Wei-Hong Liao, Guang-Dong (CN); Ming-Chiang Chen, Taipei (TW)

(73) Assignee: Cheng UEI Precision Industry Co., Ltd., New Taipei (TW)

( * ) Notice: Subject to any disclaimer, the term of this patent is extended or adjusted under 35 U.S.C. 154(b) by 5 days.

(21) Appl. No.: 13/371,341

(22) Filed: Feb. 10, 2012

(65) Prior Publication Data

US 2013/0210254 A1 Aug. 15, 2013

(51) Int. Cl.
*H01R 12/00* (2006.01)

(52) U.S. Cl.
USPC ..... 439/65

(58) Field of Classification Search
USPC ..... 439/559, 271, 349, 352, 83, 607.28, 439/607.23, 587
See application file for complete search history.

(56) References Cited

U.S. PATENT DOCUMENTS

| | | | | |
|---|---|---|---|---|
| 6,068,520 | A * | 5/2000 | Winings et al. | 439/676 |
| 6,890,193 | B2 * | 5/2005 | Kimura et al. | 439/108 |
| 7,802,994 | B1 * | 9/2010 | Chen et al. | 439/65 |
| 8,079,873 | B2 * | 12/2011 | Shih | 439/607.28 |
| 8,083,545 | B2 * | 12/2011 | Koitabashi et al. | 439/607.01 |
| 8,092,236 | B2 * | 1/2012 | Yang et al. | 439/83 |
| 8,092,252 | B2 * | 1/2012 | Peng | 439/559 |
| 8,100,719 | B2 * | 1/2012 | Ouyang et al. | 439/607.33 |
| 8,118,615 | B2 * | 2/2012 | Peng et al. | 439/607.27 |
| D658,128 | S * | 4/2012 | Xie et al. | D13/146 |
| 8,157,584 | B2 * | 4/2012 | Zhou et al. | 439/541.5 |
| 8,183,470 | B2 * | 5/2012 | Zhang et al. | 174/359 |
| D661,652 | S * | 6/2012 | Xie et al. | D13/146 |
| 8,262,413 | B2 * | 9/2012 | Fujiwara et al. | 439/607.28 |
| 8,328,576 | B2 * | 12/2012 | Chen et al. | 439/350 |
| 2011/0151708 | A1 * | 6/2011 | Kaneko et al. | 439/404 |

* cited by examiner

*Primary Examiner* — Alexander Gilman
(74) *Attorney, Agent, or Firm* — Cheng-Ju Chiang

(57) ABSTRACT

A receptacle connector includes an insulating housing with a plurality of openings apart opened in a front face thereof. A terminal group includes a ground terminal embedded in the insulating housing. The terminal group has a plurality of contact slices molded in the insulating housing and exposed through the openings respectively, and a plurality of touching arms elastically stretching outside the insulating housing. At least one connecting member is molded in the insulating housing to electrically connect with the ground terminal, and has a connecting slice exposed outside and abreast with the front face of the insulating housing. A metal shell is mounted to the front face of the insulating housing and point welded with the connecting slice. A window is opened in the metal shell and located to face the openings for further exposing the contact slices therethrough. A waterproof washer is sealed around the metal shell.

7 Claims, 4 Drawing Sheets

RECEPTACLE CONNECTOR

BACKGROUND OF THE INVENTION

1. Field of the Invention

The present invention relates to a receptacle connector, and particularly to a receptacle connector having a waterproof function.

2. The Related Art

At present, connectors are often used as main connecting components for telecommunication in all kinds of electronic products. The connector generally includes an insulating housing, a plurality of terminals assembled in the insulating housing, and a metal shell removably mounted to the insulating housing. However, since the connector has no waterproof structure, external water is apt to enter the connector to influence the signal transmission of the connector. Furthermore, the metal shell is completely exposed outside the insulating housing, as a result, the metal shell is apt to get rusty so that further affects the basic performance of the connector.

SUMMARY OF THE INVENTION

An object of the present invention is to provide a receptacle connector. The receptacle connector includes an insulating housing with a plurality of openings being apart opened in a front face thereof. A terminal group includes a ground terminal embedded in the insulating housing. The terminal group has a plurality of contact slices molded in the insulating housing and further exposed through the openings respectively, and a plurality of touching arms elastically stretching outside the insulating housing. At least one connecting member is molded in the insulating housing to electrically connect with the ground terminal. The connecting member has a connecting slice exposed outside and abreast with the front face of the insulating housing. A metal shell is mounted to the front face of the insulating housing and point welded with the connecting slice of the connecting member. A window is opened in the metal shell and located to face the openings of the insulating housing for further exposing the contact slices therethrough. A waterproof washer is sealed around the metal shell.

As described above, the connecting member is molded in the insulating housing, the metal shell is mounted to the front face of the insulating housing and point welded with the connecting slice of the connecting member, and the waterproof washer is sealed around the metal shell, so the receptacle connector has an excellent waterproof function.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
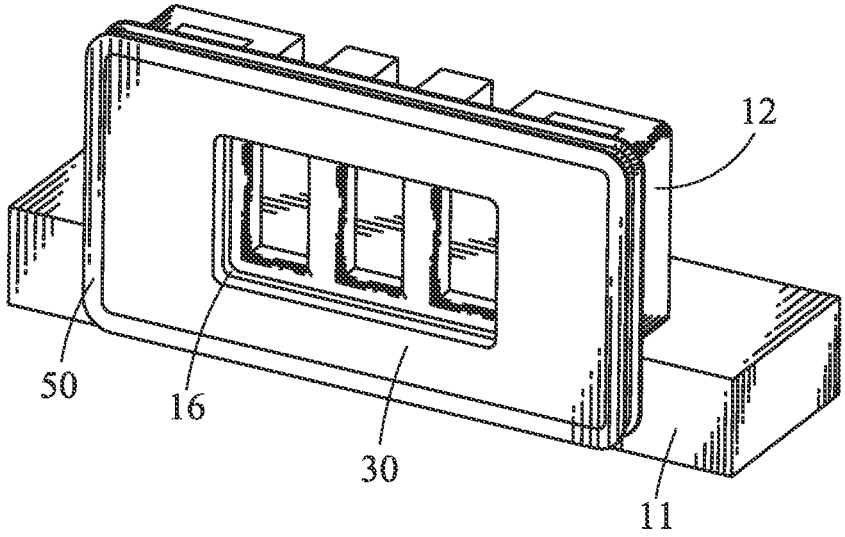
FIG. 1 is an assembled perspective view of a receptacle connector in accordance with an embodiment of the present invention.
Figure 2:
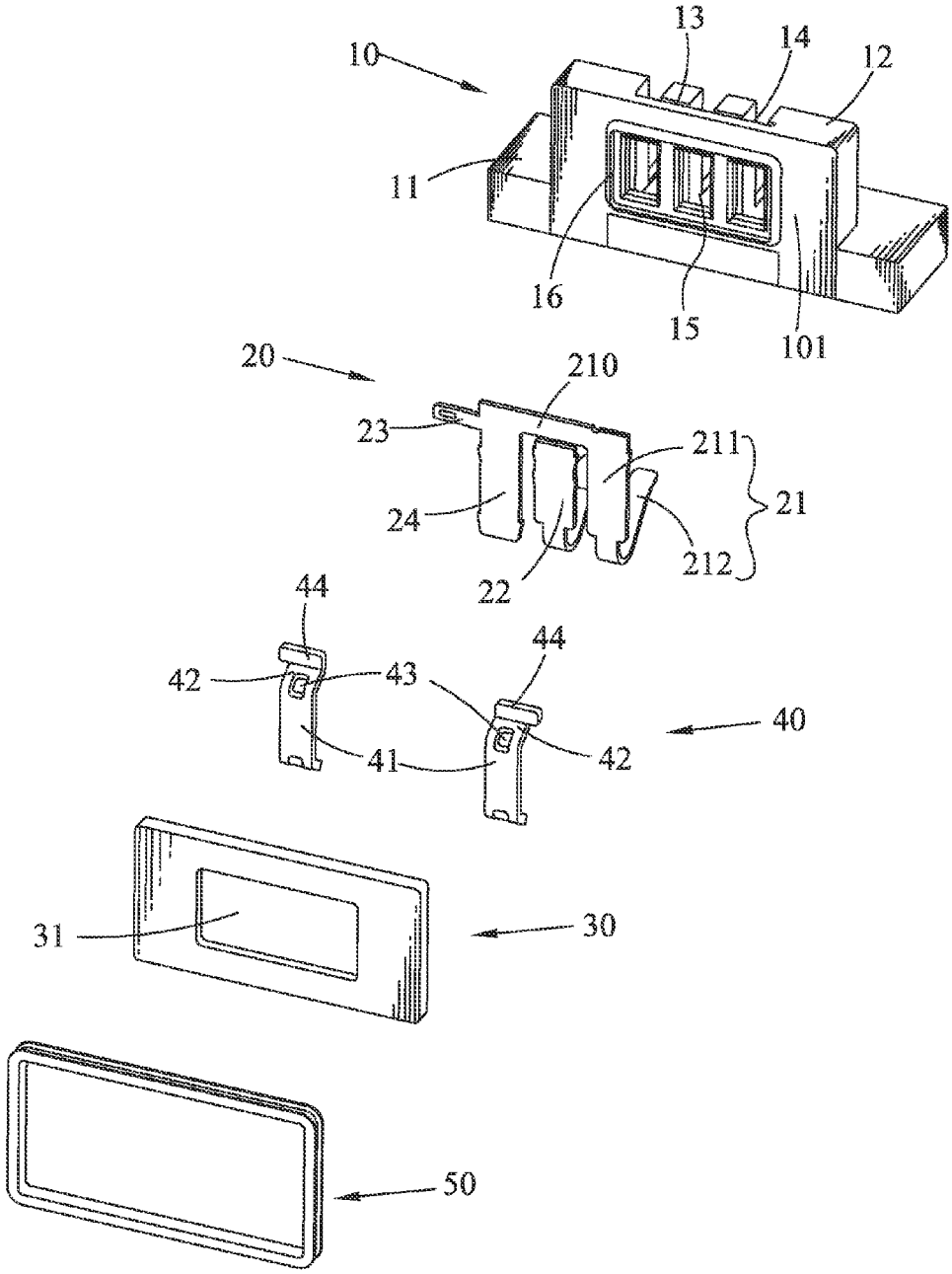
FIG. 2 and FIG. 3 are exploded perspective views of the receptacle connector shown in FIG. 1.

Referring to FIGS. 1-2, a receptacle connector according to an embodiment of the present invention includes an insulating housing 10, a terminal group 20, and a metal shell 30 mounted to a front of the insulating housing 10.

With reference to FIGS. 1-4, the insulating housing 10 has a base portion 11 and a holding portion 12 extending upward from a front of the base portion 11. An inserting slot 13 is opened in a top of the holding portion 12. A plurality of openings 15 is apart opened in a front face 101 of the insulating housing 10. A bottom side of the inserting slot 13 is concaved downward to form a plurality of fastening slots 14 opened behind the openings 15 respectively and connecting with the corresponding openings 15. A rear of the base portion 11 defines a plurality of receiving passages 17 each extending along a front-to-rear direction to connect with a bottom of the corresponding fastening slot 14. The receiving passages 17 further penetrate through a top side of the base portion 11. The front face 101 of the insulating housing 10 protrudes forward to form a holding ring 16 surrounding the openings 15.

Figure 3:
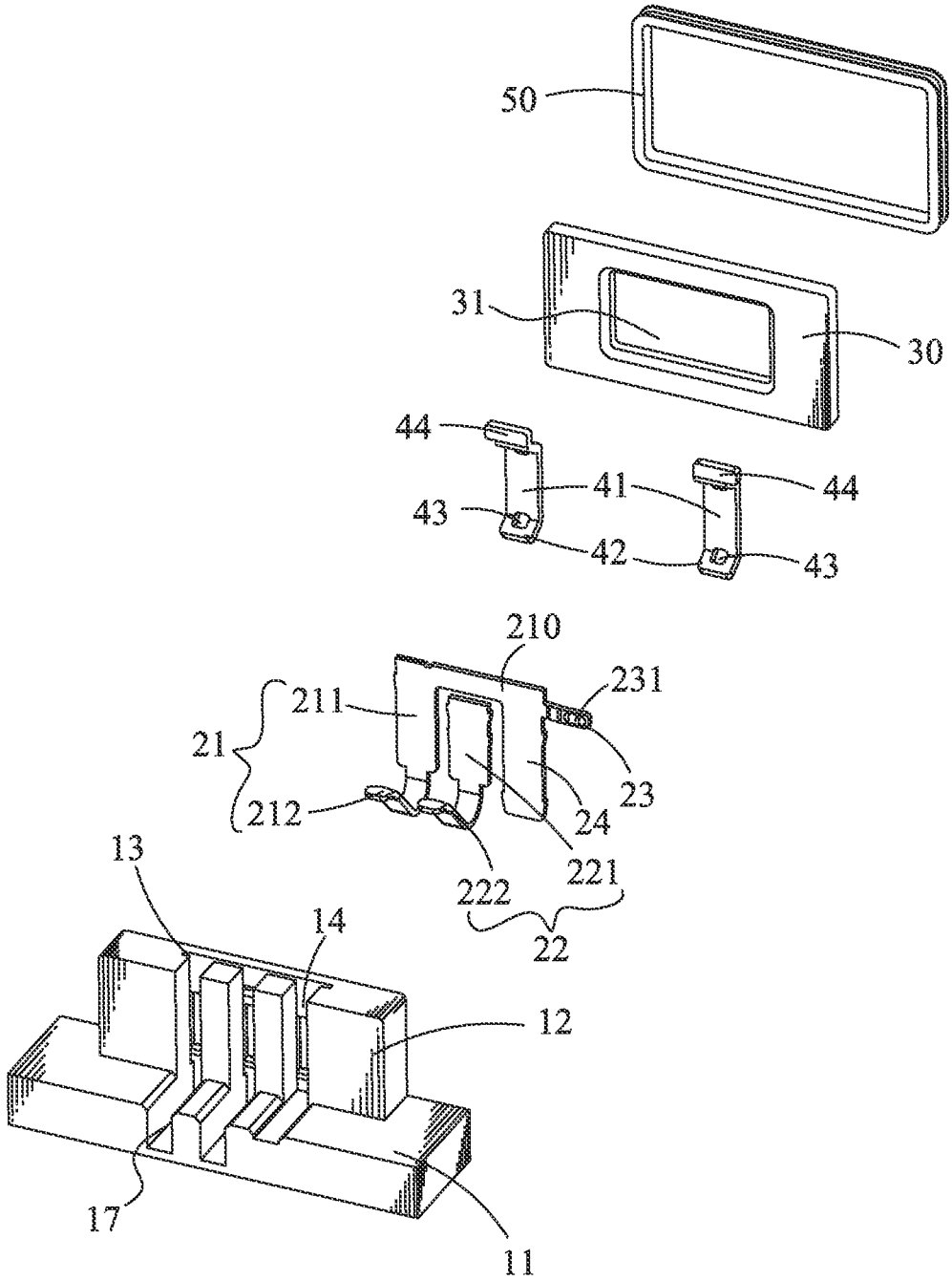

Referring to FIGS. 2-3, the terminal group 20 has a base strip 210 of which one end extends sideward to form a ground terminal 23 and the other end is connected with a power terminal 21. A contact block 231 protrudes rearward on the ground terminal 23. The power terminal 21 has a contact slice 211 extending downward from the other end of the base strip 210 and a touching arm 212 bending rearward and inclining upward from a bottom end of the contact slice 211. The terminal group 20 further includes a signal terminal 22 independent of the ground terminal 23 and the power terminal 21, and a fixing terminal 24 of a rectangular slice shape extending downward from the one end of the base strip 210. The signal terminal 22 has a structure similar to that of the power terminal 21 and has a contact slice 221 and a touching arm 222. The base strip 210 is molded in the inserting slot 13 of the insulating housing 10. The ground terminal 23 is embedded in the holding portion 12 of the insulating housing 10. The fixing terminal 24 and the contact slices 211, 221 of the power terminal 21 and the signal terminal 22 are molded in the fastening slots 14, and further exposed through the openings 15 respectively. The touching arms 212, 222 of the power terminal 21 and the signal terminal 22 elastically project upward out of the receiving passages 17 and are located behind the holding portion 12. In the embodiment, the signal terminal 22 is located between the fixing terminal 24 and the power terminal 21.

Figure 4:
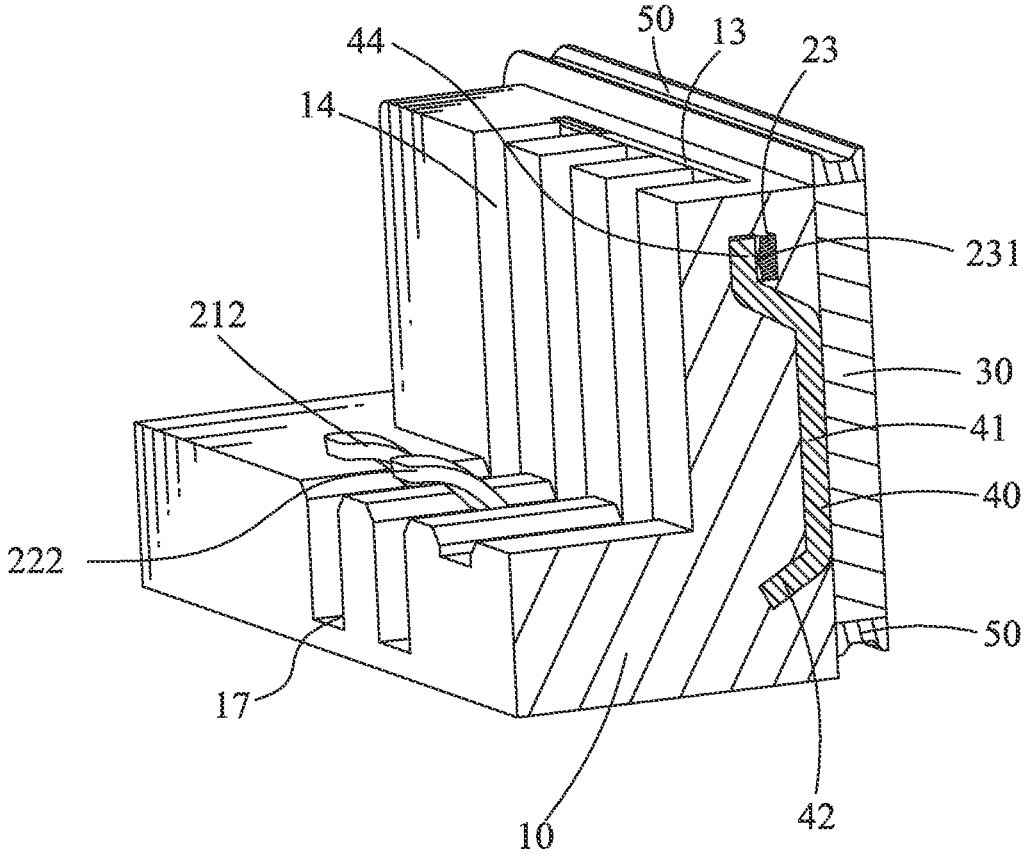
FIG. 4 is a sectional perspective view of the receptacle connector shown in FIG. 1.

Referring to FIGS. 2-4, the receptacle connector further includes at least one connecting member 40 molded in the insulating housing 10 to electrically connect with the ground terminal 23. The connecting member 40 has a connecting slice 41 exposed outside and abreast with the front face 101 of the insulating housing 10. The connecting slice 41 of the connecting member 40 has a top end and a bottom end thereof slantwise bent rearward to respectively form a strengthening portion 42. A free end of one strengthening portion 42 bending from the top end of the connecting slice 41 protrudes upward to form a strengthening tail 44 of which one end is further elongated sideward beyond a side edge of the connecting slice 41. The strengthening portions 42 and the strengthening tail 44 are embedded in the insulating housing 10 with the contact block 231 of the ground terminal 23 electrically abutting against a front side of the strengthening tail 44. A pair of holding holes 43 is opened at the junctions of the connecting slice 41 and the strengthening portions 42 for gathering plastic material therein in the process of injection molding the insulating housing 10 around the connecting member 40 and the terminal group 20 so as to reinforce the connecting member 40 and the insulating housing 10 together.

Referring to FIGS. 1-4, the metal shell 30 is mounted to the front face 101 of the insulating housing 10 and point welded with the connecting slice 41 of the connecting member 40. In the embodiment, the metal shell 30 is of a board shape. A window 31 is opened in the metal shell 30 and located to face the openings 15 of the insulating housing 10 for further exposing the contact slices 211, 221 and the fixing terminal 24 therethrough. An outer periphery of the holding ring 16 of the insulating housing 10 abuts against an inner periphery of the window 31 to secure the metal shell 30 and the insulating housing 10 together. The receptacle connector further includes a waterproof washer 50 sealed around the metal shell 30.

As described above, the connecting member 40 is molded in the insulating housing 10, the metal shell 30 is mounted to the front face 101 of the insulating housing 10 and point welded with the connecting slice 41 of the connecting member 40, and the waterproof washer 50 is sealed around the metal shell 30, so the receptacle connector has an excellent waterproof function.

What is claimed is:

1. A receptacle connector, comprising:

an insulating housing, a plurality of openings being apart opened in a front face of the insulating housing;

a terminal group having a plurality of contact slices molded in the insulating housing and further exposed through the openings respectively, and a plurality of touching arms elastically stretching outside the insulating housing, the terminal group including a ground terminal embedded in the insulating housing;

at least one connecting member molded in the insulating housing to electrically connect with the ground terminal, the connecting member having a connecting slice exposed outside and abreast with the front face of the insulating housing;

a metal shell mounted to the front face of the insulating housing and point welded with the connecting slice of the connecting member, a window being opened in the metal shell and located to face the openings of the insulating housing for further exposing the contact slices therethrough; and a waterproof washer sealed around the metal shell;

wherein the connecting slice of the connecting member has a top end and a bottom end thereof slantwise bent rearward to respectively form a strengthening portion, a free end of one strengthening portion bending from the top end of the connecting slice protrudes upward to form a strengthening tail of which one end is further elongated sideward beyond a side edge of the connecting slice, the strengthening portions and the strengthening tail are embedded in the insulating housing with the ground terminal electrically abutting against a front side of the strengthening tail.

2. The receptacle connector as claimed in claim 1, wherein the front face of the insulating housing protrudes forward to form a holding ring surrounding the openings, an outer periphery of the holding ring resists against an inner periphery of the window to secure the metal shell and the insulating housing together.

3. The receptacle connector as claimed in claim 1, wherein a pair of holding holes is opened at the junctions of the connecting slice and the strengthening portions for gathering plastic material therein in the process of injection molding the insulating housing around the connecting member and the terminal group so as to reinforce the connecting member and the insulating housing together.

4. A receptacle connector, comprising:

an insulating housing a plurality of openings being apart opened in a front face of the insulating housing;

a terminal group having a plurality of contact slices molded in the insulating housing and further exposed through the openings respectively, and a plurality of touching arms plastically stretching outside the insulating housing, the terminal group including a ground terminal embedded in the insulating housing;

at least one connecting member molded in the insulating housing to electrically connect with the ground terminal, the connecting member having a connecting slice exposed outside and abreast with the front face of the insulating housing;

a metal shell mounted to the front face of the insulating housing, and point welded with the connecting slice of the connecting member, a window being opened in the metal shell and located to face the openings of the insulating housing for further exposing the contact slices therethrough; and a waterproof washer scaled around the metal shell;

wherein the terminal group has a base strip of which one end extends sideward to form the ground terminal and the other end is connected with a power terminal, the power terminal has the contact slice extending downward from the other end of the base strip and the touching arm bending rearward and inclining upward from a bottom end of the contact slice, the terminal group further includes a signal terminal independent of the ground terminal and the power terminal, the signal terminal has a structure similar to that of the power terminal, and has the contact slice and the touching arm, the base strip is embedded in the insulating housing with the signal terminal located between the ground terminal and the power terminal.

5. The receptacle connector as claimed in claim 4, wherein a contact block protrudes rearward on the ground terminal and electrically abuts against the front side of the strengthening tail of the connecting member.

6. The receptacle connector as claimed in claim 4, wherein the insulating housing has a base portion and a holding portion extending upward from a front of the base portion, an inserting slot is opened in a top of the holding portion for clipping the base strip of the terminal group therein, a bottom side of the inserting slot is concaved downward to apart form a plurality of fastening slots opened behind the openings respectively and connecting with the corresponding openings for inserting the contact slices therein, a rear of the base portion defines a plurality of receiving passages each extending along a front-to-rear direction to connect with a bottom of the corresponding fastening slot, the receiving passages further penetrate through a top side of the base portion, the touching arms of the terminal group project upward out of the receiving passages and are located behind the holding portion.

7. The receptacle connector as claimed in claim 4, wherein the terminal group further includes a fixing terminal of a rectangular slice shape extending downward from the one end of the base strip, the fixing terminal is molded in the insulating housing and located between the ground terminal and the contact slice of the signal terminal, the fixing terminal is also exposed through one of the openings of the insulating housing and the window of the metal shell.

* * * * *